United States Patent [19]

Young

[11] Patent Number: 4,501,077

[45] Date of Patent: Feb. 26, 1985

[54] SOLE FOR BOOTS AND SHOES

[75] Inventor: Delton W. Young, Belmont, Mass.

[73] Assignee: The Goodyear Tire & Rubber Company, Akron, Ohio

[21] Appl. No.: 481,183

[22] Filed: Apr. 1, 1983

[51] Int. Cl.[3] ..... A43B 13/04; A43B 13/00

[52] U.S. Cl. ..... 36/32 R; D2/320; 36/59 C; 36/25 R

[58] Field of Search ..... 36/7.6, 7.7, 25 R, 32 R, 36/59 C; D2/271, 274, 320

[56] References Cited

U.S. PATENT DOCUMENTS

| | | | |
|---|---|---|---|
| D. 240,472 | 7/1976 | Sironi | D2/320 |
| 2,433,303 | 12/1947 | Spini | 36/59 C |
| 3,662,478 | 5/1972 | Schwab | 36/59 C |
| 4,060,917 | 12/1977 | Canale | 36/59 C |
| 4,255,874 | 3/1981 | Sironi | 36/32 R |

FOREIGN PATENT DOCUMENTS

| | | | |
|---|---|---|---|
| 931819 | 7/1955 | Fed. Rep. of Germany | 36/32 R |
| 255084 | 6/1948 | Switzerland | 36/59 C |

*Primary Examiner*—Werner H. Schroeder
*Assistant Examiner*—Steven N. Meyers
*Attorney, Agent, or Firm*—Alvin T. Rockhill

[57] ABSTRACT

This invention pertains to soles for boots and shoes. More particularly, it pertains to a sole that is useful for mountain climbing boots, hiking boots, walking shoes, and work shoes.

This invention reveals a sole for boots, shoes and the like including a heel at the rear end of said sole, said sole having a pair of edges which extend the length of said sole, comprising:

(a) said heel having a rear portion at the rear end of said heel and a breast at the front of said heel, said breast being substantially perpendicular to the length of the sole;

(b) a toe portion at the front end of said sole (c) a shank area adjacent to said heel; and (d) a tread portion extending continuously between said toe portion and said shank area; said tread portion comprising:

(1) a plurality of main lugs which are substantially perpendicular to the length of the sole, with said lugs increasing in width from the inside to the outer edge of the sole; and (2) a continuous center lug which is substantially parallel to the length of the sole and being connected to said plurality of main lugs on both of its sides, said center lug is approximately an equal distance from the edges of said sole.

15 Claims, 6 Drawing Figures

SOLE FOR BOOTS AND SHOES

FIELD OF THE INVENTION

This invention pertains to soles for boots and shoes. More particularly, it pertains to a sole that is useful for mountain climbing boots, hiking boots, walking shoes, and work shoes.

BACKGROUND OF THE INVENTION

Soles for boots, shoes, and the like are presently fabricated as distinct articles of manufacture for sale to shoe and boot manufacturers. The soles are affixed, as by sewing, gluing or the like, to an upper portion of a shoe or boot in a terminal stage of manufacture.

Soles for boots and shoes of various styles and designs are presently commercially available on an essentially worldwide basis. The general objective of a boot or shoe is to provide its wearer with protection and support for the foot. It is also important for a boot or shoe to provide its wearer with adequate traction to accomplish his objective (mountain climbing, rock climbing, hiking, working, walking, athletics, etc.). Boots and shoes are generally manufactured with a specific purpose in mind, such as dress shoes, baseball shoes, tennis shoes, mountain climbing boots, hiking boots, etc. For example, if a person is hiking a long distance wearing shoes, such as tennis shoes, which are very flexible both in the soles and in the uppers, the hiker rapidly becomes tired. This is due to the extreme flexibility of the shoe which results in the foot muscles, and also the muscles in the ankle, being flexed and worked as walking occurs. On the other hand, in a hiking boot the sole of the boot is substantially stiffer than in a tennis shoe and provides substantially greater support for the ankle. As a result, during walking while wearing a hiking boot the foot muscles are flexed and worked to a substantially reduced degree, with the result that the foot muscles are not so rapidly fatigued. It is very apparent that hiking boots are not satisfactory for playing tennis due to their greater weight and rigidity which would both slow the tennis player's foot movement and reduce his agility.

It is very apparent that boots and shoes are designed for use in specific activities. The design of the sole is a very significant aspect, if not the principle aspect, of the boot or shoe in this regard.

SUMMARY OF THE INVENTION

This invention provides an improved sole for use on mountain climbing boots, rock climbing boots, hiking boots, army boots, work shoes and the like. The sole is provided as a separate article of manufacture which can be connected to an upper of a boot or shoe in the last stages of manufacture. This improved sole features a series of main lugs which are substantially perpendicular to the length of the sole which extend to the edges of the sole from a center lug which is substantially parallel to the length of the sole which runs from the toe portion to the shank area of the sole. The center lug is approximately an equal distance from the edges of said sole, in other words, it runs along the center line of the sole. The main lugs increase in width as they approach the outer edge of the sole from the center lug. Thus, the grooves between the main lugs decrease in width as they approach the outer edge of the sole. In a preferred embodiment of this invention, each of the main lugs is tapered on both sides that are substantially perpendicular to the length of the sole, adjacent to the main groove, with the angle of taper being at least 15 degrees. This design of the main lug provides excellent traction and minimizes the possibility of stones and/or dirt being trapped in the main groove of the sole. This sole is designed to be self-cleaning since dirt and stones have a great propensity to simply fall out of the grooves in lieu of being trapped therein. The center lug in the sole of this invention provides the inside of the foot with support and the main lugs that increased in size from the inside of the sole to the outside provide their maximum support at the outside edges of the sole. Mountain climbers generally depend on the outside edge of their boot for edging purposes. Since the main lugs of the sole of this invention have their maximum width at the outside edge they provide a mountain or rock climber with maximum support where he needs it, at the outer edge of the sole.

Another aspect of this invention is that the toe portion and heel portion of the sole can be made of a harder rubber than the remaining portion of the sole. It is desirable for such a sole to have a harder toe and heel portion because it provides mountain and rock climbers greater purchase on edge holes on rocks. A harder heel and toe portion also provides the sole with greater wear and increased durability. It is also desirable for the remaining portion of the sole to be made of a softer rubber since a softer rubber can provide the sole with a higher friction coefficient for greater traction. Thus, it has been found to be desirable to produce shoe soles that have hard toe portions and hard heel portions relative to the rest of the sole.

This invention reveals a sole for boots, shoes and the like comprising:

A sole for boots, shoes and the like, including a heel at the rear end of said sole, said sole having a pair of edges which extend the length of said sole, comprising:

(a) said heel having a rear portion at the rear end of said heel and a breast at the front of said heel, said breast being substantially perpendicular to the length of the sole;

(b) a toe portion at the front end of said sole (c) a shank area adjacent to said heel; and (d) a tread portion extending continuously between said toe portion and said shank area; said tread portion comprising:

(1) a plurality of main lugs which are substantially perpendicular to the length of the sole, with said lugs increasing in width from the inside to the outer edge of the sole; and (2) a continuous center lug which is substantially parallel to the length of the sole and being connected to said plurality of main lugs on both of its sides, said center lug is approximately an equal distance from the edges of said sole.

DESCRIPTION OF THE DRAWINGS

The above-mentioned and other features of this invention are more fully set forth in the following detailed description of several embodiments of this invention, including a presently preferred embodiment, which are illustrated in the accompanying drawing, wherein.

DESCRIPTION OF THE ILLUSTRATED EMBODIMENTS

A shoe or boot sole 10, which is a presently preferred embodiment of this invention is shown in FIGS. 1, 2, 3 and 4. Sole 10 is provided as a marketable article of manufacture. The sole is used by manufacturers of boots and shoes as a component of the finished product. Typically, the sole is affixed, as by glueing or soling to a middle sole element of the boot or shoe. The middle sole is a component of a boot or shoe upper or body which is built in a suitable last. The middle sole typically is incorporated into the upper prior to the removal of the upper from the last, after which outer sole 10 according to this invention, is affixed to the boot or shoe. Typically, the middle sole is trimmed around its periphery to conform to the peripheral configuration of the outer sole after the outer sole has been attached to the upper.

Figure 2:
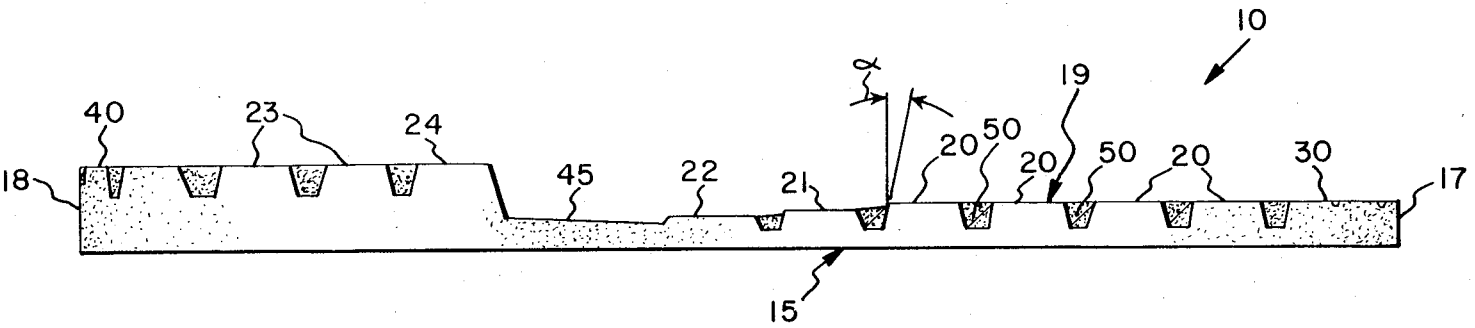
FIG. 2 is a side view of the sole shown in FIG. 1.
Figure 4:
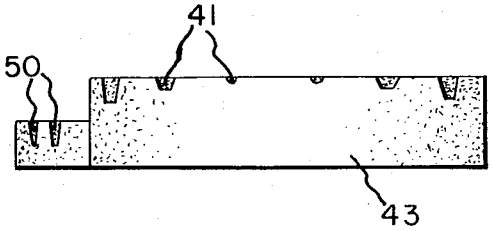
FIG. 4 is a back view of the sole shown in FIG. 1.
Figure 3:
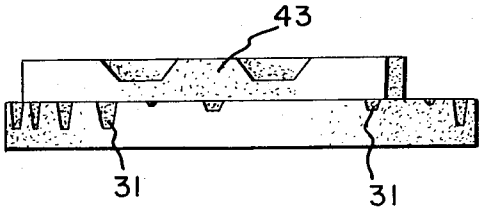
FIG. 3 is a front view of the sole shown in FIG. 1.

As shown best in FIG. 2, sole 10 has a top surface 15 and a bottom tread surface 16. The bottom tread surface 16, is the ground contacting surface of the sole. Sole 10 has a toe portion 30, a heel 40, a shank area 45 adjacent heel 40 and located between said toe portion 30 and shank area 45 is a tread portion 19. Tread portion 19 has a series of main lugs 20, 21, and 22 separated by adjacent main grooves 50. It is preferred for these main lugs 20, 21 and 22 to differ in heighth, as is shown in FIG. 2, with forward main lugs 20, being higher, as measured from the top of the lugs to the base of adjacent main grooves 50, than intermediate main lugs 21, which in turn are higher than the rear main lugs 22. It is not essential for these main lugs 20, 21 and 22 to differ in heighth in this manner but it is generally preferred. In the most preferred embodiment of this invention, illustrated in the drawings, the top surface 15 of the rear main lug 22 is a distance of 5/16 inch from the top surface 15 of sole 10, with bottom tread surface 16 of intermediate main lug 21 being 6/16 inch from the top surface 15 of the sole with bottom tread surface 16 on the forward main lugs 20 being about 7/16 of an inch from the top surface 15 of the sole. As measured from the top of the lugs to the base of adjacent grooves 50, in the most preferred embodiment of this invention, rear main lug 22 has a heighth of about 1/16 inch, intermediate main lug 21 has a heighth of about $\frac{1}{8}$ inch, and the forward main lugs 20 have a heighth of about 3/16 inch.

It is also generally preferred for the bottom tread surface 16 on the toe portion 30 to be the same distance from the base of adjacent main grooves 50 of the sole as is the bottom tread surface 16 on the forward main lugs 20. Thus, in the most preferred embodiment of this invention the bottom tread surface 16 on the toe portion 30 is about 7/16 of an inch from the top surface 15 of sole 10. In the most preferred embodiment of this invention the distance between the bottom tread surface 16 on the heel portion 40 of the sole to top surface 15 is about 13/16 inch. The distance from the top surface 15 of the sole to the invention about 13/16 inch. If a heavier sole is desired the distance between the bottom tread surface 16 and the top surface 15 of the sole 10 can be uniformly increased. For example, by adding 1/16 inch or even $\frac{1}{8}$ inch to the preferred distances of the top surface 15 from the bottom tread surface 16 previously described. On the other hand, if a lighter sole is desired then the distances from the top surface 15 to the bottom tread surface 16 can be unformly decreased.

Figure 1:
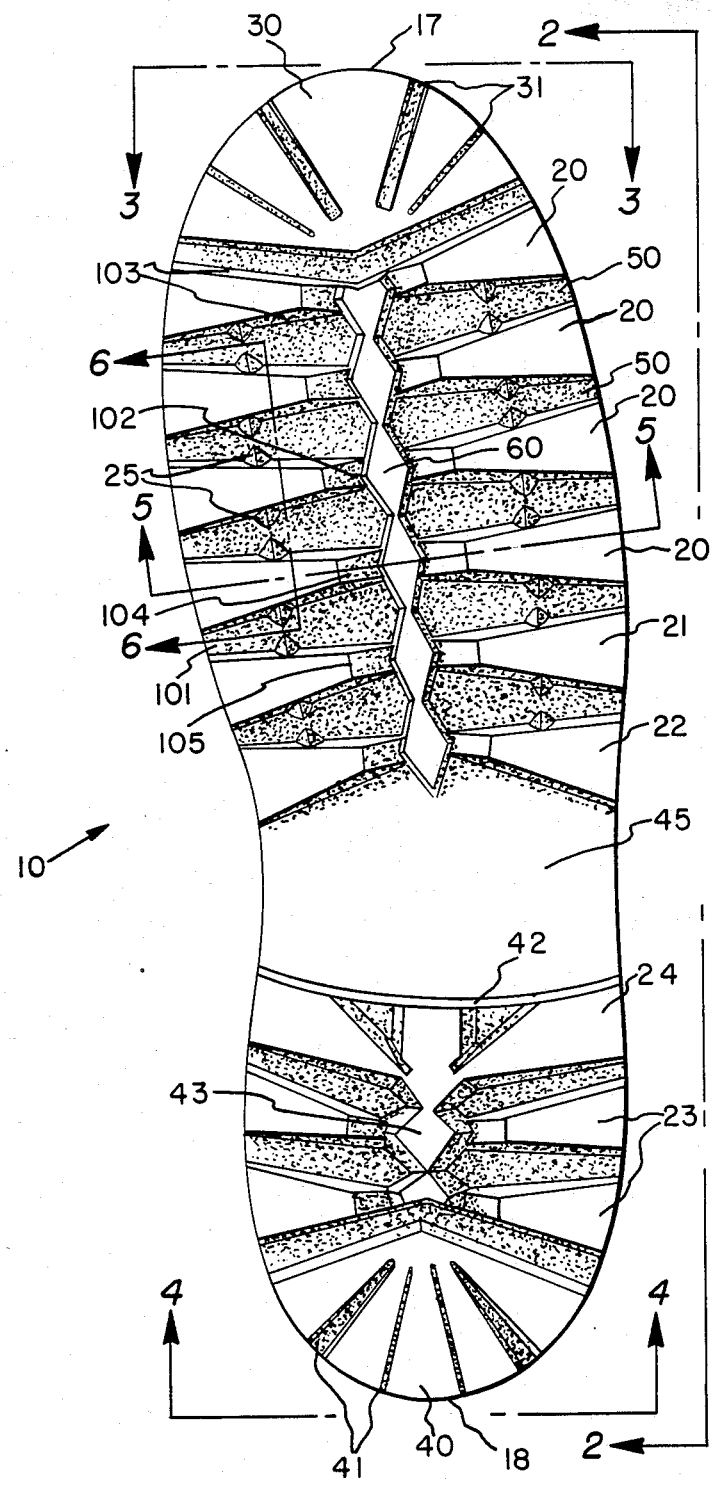
FIG. 1 is a bottom plan view of the presently preferred sole.

As can best be seen in FIG. 1 the main lug 20, 21, and 22 increase in width as they approach the outer edges of the sole from the inside (center lug 60). In the most preferred embodiment of this invention the width of these main lugs as measured along a line that is substantially parallel to the length of the sole increases from the inside of the sole to the outside of the sole in such a way that the ratio of the main lug measured at inner end 102 adjacent the center lug 60 to the width of the lug on the outer edge 101 of the sole is about 2:5. Strict compliance with this ratio is not required, however, generally the width of the main lugs on the inner end 102 which is adjacent to center lug 60 to the width of the main lugs on the outer edge 101 of the sole 10 as measured along a line parallel to the direction of the sole, should be at least 1:2 and no more than about 1:3. In the particular embodiment of this invention the width of inner end 102 of main lugs 20, 21, and 22 is about $\frac{1}{4}$ inch and the width of lugs 20, 21, and 22 at outer edge 101 is about $\frac{5}{8}$ inch.

In the preferred form of the present invention the heel 43 is provided with lugs 23 and 24 forward of rear portion 40. Lugs 23 and 24 being separated by adjacent main grooves 50. It is generally also preferred for the forward main lugs 20, the intermediate main lugs 21 and main grooves 50. It is generally also preferred for the forward main lugs 20, the intermediate main lugs 21 and the rear main lugs 22 to have a width as measured in a direction substantially parallel to the length of the sole at the outer edge of the sole of about $\frac{5}{8}$ inch. It is generally preferred for the forward heel main lug 24 to be slightly wider at the outer edge of the sole than the other main lug, perhaps 1/16 inch or even $\frac{1}{8}$ inch wider. It has been found that if the forward heel main lug 24 is slightly larger that the durability of the sole (specifically the heel) is substantially improved.

In the preferred embodiment of this invention the distance between the top surface 15 of the sole and the bottom tread surface 16 in the main groove 50 is about 3/16 inch to about $\frac{1}{4}$ inch. Thus, the depth of the main groove 50 between the forward main lug 20 is about $\frac{1}{4}$ inch.

The main lugs 20 through 24 are preferably tapered on both sides 103 that are substantially perpendicular to the length of the sole, for instance, the sides that are adjacent to main groove 50. This can best be seen in FIG. 2 which shows said lugs having an angle of taper $\alpha$. The angle $\alpha$ of taper must be at least 15 degrees. Soles can be designed which are within the scope of this invention wherein the angle of taper $\alpha$ ranges anywhere between 15 degrees and about 30 degrees. In the most preferred embodiment of this invention the angle $\alpha$ is about 25 degrees. Since main lugs 20, 21,22, 23 and 24 of the sole of this invention are tapered in this way the propensity for dirt and stones to become trapped in the main groove 50 between between the main lug is substantially reduced. Accordingly, the sole of the present invention is designed to be self-cleaning with stones and dirt simply falling out of the main groove 50 as the person wearing the sole walks.

The main lugs may also have a tapered portion 104 at the inner end 102 from point 105 to substantially the base of center lug 60, the point 105 being spaced a distance B from the outer edge 101 of the sole, the distance B being at least one-half the distance C from the outer edge 101 to the center line 107 of sole 10. It is preferred that the distance B be about $\frac{3}{4}$ the distance C.

Figure 5:
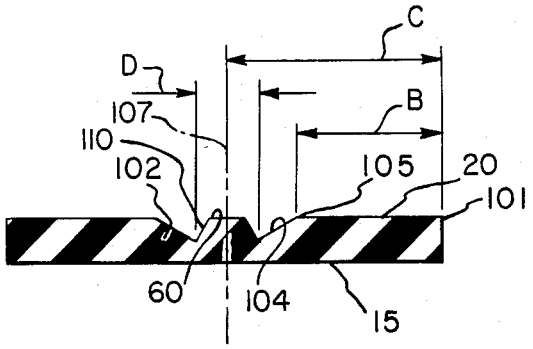
FIG. 5 is a cross-sectional view taken along line 5—5 in FIG. 1.
Figure 6:
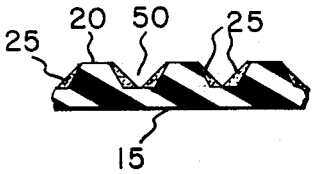
FIG. 6 is a sectional view taken along line 6—6 in FIG. 1.

In the most preferred embodiment of this invention the sides of center lug 60 is of a zigzag design, which in the present invention preferably a series of interconnected diamonds, as can best be seen in FIG. 1. The width D of the center lug 60 preferably varies along this zigzag pattern from a maximum width adjacent to the main lugs, wherein D shown in FIG. 5 is about $\frac{1}{4}$ the value of distance C shown in FIG. 5 to a minimum width located at points about midway between the main lugs, wherein the width D is about $\frac{1}{8}$ the distance of C. Thus, center lug 60 increases and decreases in width moving along its zigzag pattern in the most preferred embodiment of this invention. The center lug 60 is over twice as wide at its wide points, adjacent to the main lugs 20, than it is at its narrowest width which is approximately midway between main lugs. It is preferred for the sides 110 of the center lug 60 that are adjacent to the main grooves 50 are tapered at an angle of at least 15 degrees with respect to the plane perpendicular to bottom surface, as were the sides of the main lugs that were adjacent to the main grooves. The center lug 60 of sole 10 runs from the extreme front end of tread portion 19 to a shank area 45 in the sole. The center lug 60 in combination with the main lugs being tapered toward the center of the sole substantially improve the lateral traction of the sole. It is generally preferred for 20, 21, and 22 main lugs adjacent to the center lug 60 to be about $\frac{1}{4}$ to $\frac{1}{3}$ the heighth of the main lugs at the edge of the sole 101, as measured from the top of the lugs to the base of adjacent grooves 50.

It is generally desirable for there to be buttresses 25, which can be best seen in FIG. 1, which are adjacent to the forward main lugs 20, intermediate main lugs 21 and rear main lugs 22. These buttresses extend into the main grooves 50 and both support the main lugs and provide lateral grip for the sole.

Immediately adjacent the rear of the shank area 45 at the front of heel 43 is breast 42. The breast 42 is substantially perpendicular to the length of the sole. It is preferred for the breast 42 be slightly rounded and in the most preferred embodiment of this invention the breast of the sole 42 is rounded based on a 6 inch radius. It is generally preferred for the breast 42 of the heel 43 to be oriented in such a way that it is essentially perpendicular to the direction of travel. In the most preferred embodiment of this invention heel 43 will contain main lugs 23 and 24 but this is not an essential feature of the invention.

The heel 43 of sole 10 contains a distinct rear portion 40. The rear portion 40 can have heel grooves 41 in it but this is not an essential feature of the invention. In some cases, such as for mountain climbing it will be desirable for the heel portion 40 to be made of a harder material (rubber) than is the remaining portion of the sole. It will sometimes also be preferable for the toe portion 30 to also be prepared from a harder material than is the bulk of the sole. The toe portion can contain toe grooves 31 but they are not an essential element in this invention.

Generally the soles of this invention will be manufactured by compression molding rubber slugs and vulcanizing them using techniques well-known to those skilled in the art. Generally the rubber that is compression molded will contain sulfur, various accelerators, scorch inhibiting agents and antioxidants. Because the sole design of this invention has a very distinct toe portion 30 and heel portion 40 they can be simultaneously molded with the treat portion of the sole while utilizing a different type of rubber than is utilized for the tread portion 19 of the sole. Soles with harder toe portions and heel portions can be manufactured by simply utilizing a shoe mold that has its toe portion and heel portion in fenced areas as is well known in the art. Slugs from a harder rubber than is utilized for the toe portion can be placed into the fenced areas for the toe portion and heel portions while utilizing a softer rubber for the tread portion of the sole. In the most preferred embodiment of this invention the toe portion 30 and heel portion 40 of sole 10 will be composed of a rubber that has a Rex hardness of about 75 to 80 with the tread portion of the sole being composed of a rubber that has a Rex hardness of about 60 to 65. It is preferred for the rex hardness of the toe portion and heel portion of the sole to be at least 10 Rex points harder than the tread portion of the sole. It is more preferred for the toe portion and heel portion of the sole to be composed of a rubber that is about 15 rex points harder than the tread portion (remaining portion) of the sole.

Workers skilled in the art to which this invention pertains will readily appreciate that the present invention has been described above with reference to presently preferred structural arrangements for the purposes of example in furtherance of an explanation of the principles of this invention. The foregoing description is not exhaustive of all embodiments and forms which this invention may take. Modifications, alterations, and variations in the arrangements described above may be practiced without departing from the scope or spirit of this invention while relying on and taking advantage of the advantages which this invention provides. Accordingly, the foregoing description should not be considered as limiting the scope of this invention.

What is claimed is:

1. A sole for boots, shoes and the like, including a heel at the rear end of said sole, said sole having a pair of edges which extend the length of said sole, comprising:

(a) said heel having a rear portion at the rear end of said heel and a breast at the front of said heel, said breast being substantially perpendicular to the length of the sole;

(b) a toe portion at the front end of said sole (c) a shank area adjacent to said heel; and (d) a tread portion extending continuously between said toe portion and said shank area; said tread portion comprising:

(1) a plurality of main lugs which are substantially perpendicular to the length of the sole, with said lugs increasing in width from the inside to the outer edge of the sole; and (2) a continuous center lug which is substantially parallel to the length of the sole and being connected to said plurality of main lugs on both of its sides, said center lug is approximately an equal distance from the edges of said sole.

2. A sole as specified in claim 1 wherein said main lugs are tapered on both sides that are substantially perpendicular to the length of the sole.

3. A sole as specified in claim 2 wherein said main lugs are tapered on both sides that are substantially perpendicular to the length of the sole at an angle of taper of at least 15 degrees.

4. A sole as specified in claim 3 wherein said angle of taper is from 15 degrees to 30 degrees.

5. A sole as specified in claim 4 wherein said angle of taper is about 25 degrees.

6. A sole as specified in claim 1 wherein said main lugs are tapered toward the center of said sole.

7. A sole as specified in claim 1 wherein said main lugs are tapered toward the center of said sole from a point at least one-half the distance from the outer edge of the sole to the center of the sole.

8. A sole as specified in claim 7 wherein said main lugs are tapered toward the center of said sole from a point about three-fourths the distance from the outer edge of the sole to the center of the sole.

9. A sole as specified in claim 1 wherein said center lug is connected to an equal number of said main lugs on both of its sides.

10. A sole as specified in claim 1 wherein said heel portion and said toe portion are made of a harder rubber than said tread portion.

11. A sole as specified in claim 10 wherein said heel portion and said toe portion are made of a rubber that is about 15 rex points harder than the rubber from which the tread portion is made.

12. A sole as specified in claim 10 wherein said heel portion and said toe portion are made of a rubber that has a rex hardness of 75 to 80.

13. A sole as specified in claim 10 wherein said tread portion is made of a rubber that has a rex hardness of 60 to 65.

14. A sole as specified in claim 1 wherein said main lugs have buttresses on their sides that are substantially perpendicular to the length of the sole.

15. A sole as specified in claim 1 wherein said center lug has a zigzag design.

* * * * *